United States Patent [19]

Stumpp et al.

[11] 4,043,304

[45] Aug. 23, 1977

[54] FUEL INJECTION SYSTEM FOR SELF-IGNITING INTERNAL COMBUSTION ENGINES

[75] Inventors: Gerhard Stumpp; Konrad Eckert, both of Stuttgart; Detlev Runge, Gerlingen; Wolf Wessel, Schwieberdingen, all of Germany

[73] Assignee: Robert Bosch GmbH, Stuttgart, Germany

[21] Appl. No.: 465,503

[22] Filed: Apr. 30, 1974

[30] Foreign Application Priority Data

May 2, 1973 Germany ..... 2321907
Mar. 1, 1974 Germany ..... 2409774

[51] Int. Cl.[2] ..... F02M 25/06

[52] U.S. Cl. ..... 123/119 A; 123/32 R; 123/32 EA; 123/140 MC

[58] Field of Search ..... 123/119 A, 32 EA, 32 R, 123/140 MC; 60/275, 278

[56] References Cited

U.S. PATENT DOCUMENTS

| | | | |
|---|---|---|---|
| 2,991,160 | 7/1961 | Claussen | 60/288 |
| 3,470,858 | 10/1969 | Mycroft | 123/139 AW |
| 3,583,375 | 6/1971 | Pischinger | 123/119 A |
| 3,628,515 | 12/1971 | Knapp et al. | 123/119 R |
| 3,712,281 | 1/1973 | Ruth | 123/119 A |
| 3,747,577 | 6/1973 | Mauch et al. | 123/32 EA |
| 3,796,199 | 3/1974 | Knapp | 123/32 EA |
| 3,807,376 | 4/1974 | Glockler et al. | 123/119 A |
| 3,817,225 | 6/1974 | Priegel | 123/32 EA |

FOREIGN PATENT DOCUMENTS

| | | | |
|---|---|---|---|
| 858,037 | 3/1939 | France | 123/119 A |
| 1,601,374 | 10/1967 | Germany | 123/119 A |

*Primary Examiner*—Wendell E. Burns
*Attorney, Agent, or Firm*—Edwin E. Greigg

[57] ABSTRACT

What follows is a description of a fuel injection system for an internal combustion engine which employs exhaust gas recycling. The engine has a suction tube leading to the engine and an exhaust pipe leading from the engine, while the system includes a recycle line connecting both the exhaust pipe and the suction tube, and a control mechanism. The control mechanism can be located either in the suction tube, the exhaust line or the recycle line and controls the pressure therein in order to control the recycled exhaust gas flow rate. The system further has a regulating structure which regulates the quantity of the injected fuel in conjunction with the control mechanism.

45 Claims, 9 Drawing Figures

6
7
11
10
1
12
4"
5
3
58
2
64
55'
55
56
57
63
60
59
62
41
42
15
61

1
5
80
91
3
2
77
81
75
74
55
79
90
90'
73
67
78
76
65
66
70
72
86
84
85
87
83
71
15
82
68
42
69

91
99
98
99'
95
96
97
76
76
71
100

FUEL INJECTION SYSTEM FOR SELF-IGNITING INTERNAL COMBUSTION ENGINES

BACKGROUND OF THE INVENTION

The present invention relates to a fuel injection system for an internal combustion engine.

A very effective method for reducing those components of the exhaust gas of an internal combustion engine which are detrimental to health, and especially for the reduction of $NO_x$ components, is the recycling of certain quantities of the exhaust gas. Adding a gas to the combustion process which does not take part in the combustion itself results in a reduction of the combustion temperature so that fewer nitrogen oxides $NO_x$ are produced. In addition, the expelled exhaust gas quantity is also reduced. However, because gas exchange processes take place, the efficiency of the internal combustion engine deteriorates. Furthermore, at low rpm and especially during idling operation, the smooth running of the engine is affected. On the other hand, it is possible, in the partial load domain, to recycle relatively large amounts of exhaust gas in order to keep the $NO_x$ emission low and still maintain smokeless combustion. However, a large quantity of exhaust gas must be recycled. Advantageously, during idling operation, the exhaust gas recycling is small. In addition, the combustion temperature is lower and hence also the nitrogen oxide emission. In the partial load domain, however, the nitrogen oxide emission is especially high and therefore especially dangerous because in city operation, for which the most stringent exhaust gas regulations are applicable, most driving is done in the partial load domain. The regulations with respect to cross-country driving are less stringent, and in this type of driving, under full load, maximum power is required and the accumulation of toxic exhaust gases is less.

OBJECTS AND SUMMARY OF THE INVENTION

It is, therefore, a general object of the present invention to provide a fuel injection system for an internal combustion engine which utilizes recycled exhaust gas to effect a high level of pollution control.

It is a more specific object of the present invention to provide a fuel injection system for diesel engines wherein the oxygen content of the fuel in the combustion chamber is always sufficiently high to ensure smokeless combustion and in which as much exhaust gas as possible is recycled in order to achieve a combustion particularly low in $NO_x$ emissions.

These and other objects are accomplished according to the present invention in that the system operates with exhaust gas recycling and includes, in addition to a suction tube and exhaust system, a recycle line and a device which controls the pressures in the suction tube and/or the exhaust system or the recycle line. The device determines the recycle flow rate and includes a control parameter which is compared with the fuel injection quantity by means of a regulating mechanism. In all cases, the regulating mechanism or regulator ensures that, for any amount of injected fuel, sufficient combustion air is available or conversely, that an appropriate amount of fuel is metered for the aspirated air quantity.

The suction tube includes an air measuring member and a manifold portion, and ahead of the air measuring member the prevailing pressure is at least substantially atmospheric pressure while in the region of the suction tube manifold, the prevailing pressure is the reduced pressure caused by the suction strokes of the pistons. Within the exhaust system, however, the prevailing pressure is a certain amount of positive gauge pressure which can be caused by the exhaust muffler or by a throttle flap disposed downstream of the exhaust gas recycle line and this pressure is always higher than atmospheric pressure. In this way, a natural pressure gradient is created from exhaust system to suction tube and this pressure gradient causes a controllable exhaust gas recycle flow rate.

According to an advantageous embodiment of the present invention, the device which effects the control of the pressures is a throttle flap and the exhaust gas recycle line terminates in the suction tube downstream of this throttle flap. The throttle flap causes a pressure drop in the suction tube. Instead of placing the throttle flap in the suction tube, the throttle flap may be located in the exhaust line, or some other similar device in the exhaust gas recycle line may serve the same purpose; what is important is that a well adapted exhaust gas recycling is achieved on the basis of the prevailing pressures.

Advantageously, the regulator operates with an air measuring member intended to measure the fresh-air quantity flowing through the suction tube. In order to increase the engine power, it is possible to dispose a gas pump (loader) after the termination of the exhaust gas recycle line in the suction tube. Because an air measuring member is used, there is no requirement to provide a change-pressure dependent control because the aspirated fresh-air quantity is always measured and compared with the injected fuel quantity.

According to the present invention, the control parameter can be either the air quantity or the fuel quantity. In accordance with the first mentioned embodiment of the present invention, the throttle flap is arbitrarily settable, expecially by means of the gas pedal, and the control parameter of the regulator is especially the output signal given by the air measuring member.

In a corresponding embodiment of the present invention, the regulator operates with an electronic control instrument which electronically divides the air-throughput by time and rpm and generates a signal indicative of air-throughput/working cycle which serves as the reference signal for the injection. The injection device can utilize solenoid valves whose opening duration and timing correspond to the reference signal of the injection process. However, the injection device can also be an injection pump with a supply-quantity setting member coupled to the throttle flap, whose setting path is adapted to the reference signal of the injection process.

According to the second mentioned embodiment of the present invention, the quantitative supply of the fuel injection system is arbitrarily changeable and the control parameter of the regulator is the injected quantity. In constrast to the first mentioned embodiment, the regulating characteristics are given here by the regulator of the injection pump. Thus, the entire installation whose purpose is exhaust gas detoxification can be a supplementary mechanism for any injection system and, thus, consideration can be given to any and all customary regulator characteristics of injection systems, such as idling/maximum-rpm regulators, setting regulators with adjustable P-values, etc. In such processes, according to the present invention, the injection quantity and the fresh air quantity can be compared, especially by means of a bridge circuit in the regulator, where this bridge circuit changes the adjustment of the mechanism and therefore the recycle flow rate and also the fresh air flow rate during a deviation from a nominal set-value and until such time as the nominal value is achieved. The bridge circuit can use electrical or hydraulic means.

DESCRIPTION OF THE PREFERRED EMBODIMENTS

Figure 1:
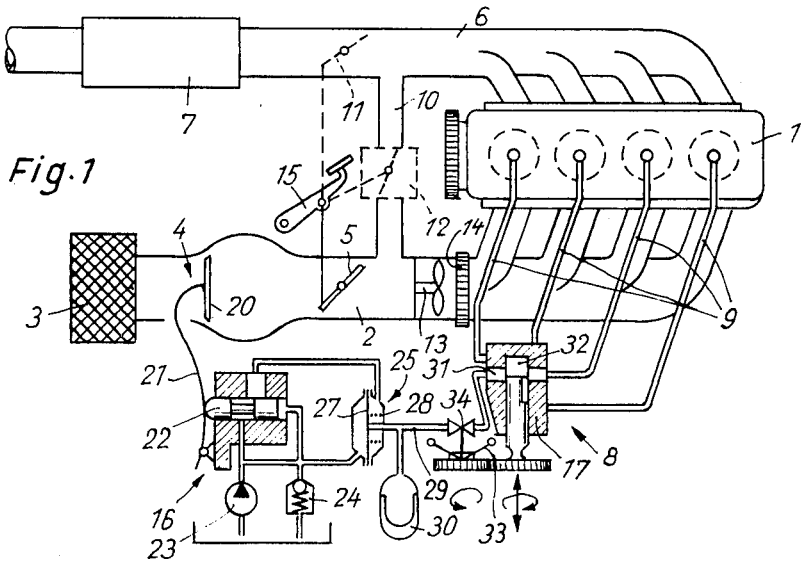
FIG. 1 is a schematic illustration of one embodiment of a fuel injection system for an internal combustion engine according to the present invention, wherein exhaust gas recycling is utilized and including details illustrated partly in cross section of various of the elements which in assembly serve to control the quantity of recycled exhaust gas to thereby reduce the pollution elements of the expelled exhaust gas.

Turning now more specifically to the various figures of the drawing, air is aspirated by an engine 1 through a filter 3, into a suction tube 2 and past an air measuring member 4 and a throttle flap 5. The exhaust gases of the engine 1 flow through an exhaust line 6 in which is disposed a muffler 7. The engine 1, which operates by self-ignition, is supplied through fuel lines 9 by a fuel injection system 8 which injects diesel fuel directly into the engine cylinders or the precombustion chambers of the cylinders. The exhaust line 6 and the suction tube 2 are connected with one another through an exhaust gas recycle line 10 so that, depending on the pressure conditions in the exhaust/suction tube installation, a variable quantity of exhaust gas flows through the recycle line 10 toward the suction side of the installation. The pressure conditions are determined in these embodiments by the throttle flap 5. Depending on the rpm or more precisely depending on how much of a fuel-and-air mixture the engine demands as a result of piston displacement volume (fuel volume aspirated), and depending on which position is taken by the throttle flap 5, the air portion of the fuel volume which cannot flow through the filter 3 because of the position of the throttle flap 5 is derived from the exhaust line 6 and flows through the exhaust gas recycle line 10. As is indicated by the broken line, these pressure conditions can also be caused by a throttle flap 11 in the exhaust line 6 of the exhaust system, which is disposed downstream of the branch point of the exhaust gas recycle line 10 with the exhaust line 6, or else by a control mechanism 12 in the exhaust gas recycle line 10. A natural pressure gradient from the suction side to the exhaust side of the engine 1 is present in any case because, due to the suction within the suction tube 2, there always prevails a certain amount of negative gauge pressure; whereas the expulsion of exhaust gas always causes a certain amount of positive gauge pressure in the exhaust system. Depending on the magnitude of the throttle action of the muffler 7 or the filter 3, this pressure difference is further increased. An even further increase of this pressure difference can be caused by a gas pump or loader 13 disposed in the suction tube 2 downstream of the branch point of the exhaust gas recycle line 10 with the suction tube 2. The important point about the regulator according to the present invention is that just exactly as much fresh air is brought through the filter 3 to the engine 1 as is required by the fuel metered by the injection system 8 so as to achieve favorable combustion. The remaining fuel volume aspirated by the engine consists of the recycled exhaust gas. A cooler 14 can be disposed behind the loader 13 in the suction tube 2 for power increase or $NO_x$ reduction.

Figure 2:
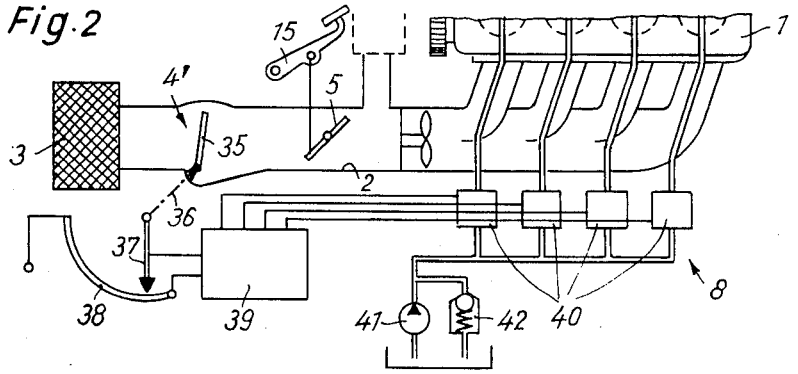
FIGS. 2 and 3 are schematic illustrations like FIG. 1 with the exhaust gas line not shown and with two other embodiments of the assembled elements which control the quantity of the recycled exhaust gas.
Figure 3:
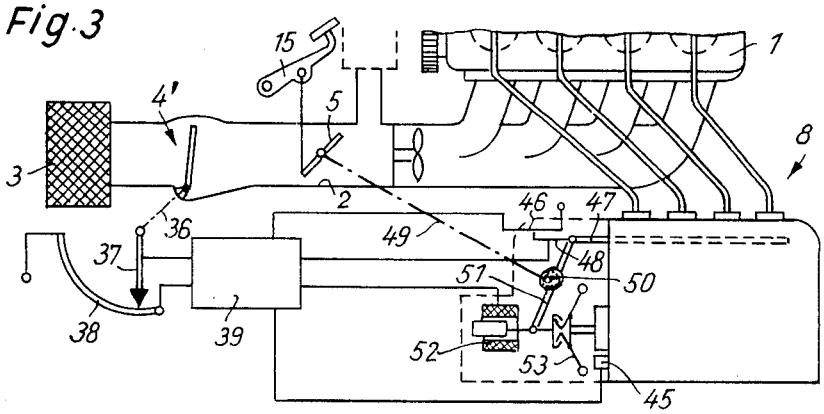

In the exemplary embodiments shown in FIGS. 1, 2 and 3, the control parameter of the regulator is the fresh air quantity determined by the throttle flap 5 and, to a certain degree, also by the rpm. The throttle flap 5 is coupled to the gas pedal 15 of the vehicle. Of course, the gas pedal 15, instead of actuating the throttle flap 5, may actuate the throttle flap 11 or the control mechanism 12.

FIG. 1 shows an exemplary embodiment in which the air measuring member 4 actuates a fuel metering valve 16 which determines the suction volume of a suction throttle injection pump 17 designed as a distribution pump. The air measuring member 4 includes a plate 20, disposed transversely to the air stream direction in the suction tube 2 and a lever 21. The plate 20 is mounted to the lever 21 which, in turn, engages a metering slide 22 which is located in the fuel flow path of a preliminary fuel supply pump 23. The pressure of the supply pump 23 is determined by a pressure control valve 24. The plate 20 is provided with a constant resetting force which is generated by means of pressure fluid acting against the rear face of the control slide 22. This pressure fluid is also pumped by the pump 23 and is regulated by the pressure control valve 24.

In order to obtain a quantity of metered fuel which corresponds to the position of the control slide 22, but which is independent of the counteracting pressures, a differential pressure valve 25 is placed behind the metering valve 16. The valve 25 includes a membrane 27 which on one side experiences the pressure prevailing ahead of the metering valve 16, and on the other side experiences the pressure prevailing behind the metering valve 16. This latter side is loaded by a spring 28 corresponding to the pressure drop at the metering valve 16.

Connected to a line 29 between the differential pressure valve 25 and an intermittently operating distribution injection pump 17 is a storage container 30. The container 30 accepts the metered fuel quantity on each occasion when the injection pump 17 closes its suction aperture 31, and then delivers it into a pump operating chamber 32 of the injection pump 17 after the aperture 31 is opened. In this way, an integrating effect is achieved.

For regulating the maximum rpm or for safety shut-off regulation, use is made of a centrifugal force regulator 33 controlling a valve 34 in the suction line 29. Hence, in this fuel injection system, the suction throttle flap 5 and the engine rpm determine what particular air quantity passes the air measuring member 4, corresponding to which a particular fuel quantity is metered out by the fuel metering system 16. This fuel quantity determines the filling quantity of the fuel injection pump 17. Thus, the injected fuel quantity can always be adapted to the fresh air quantity in order to obtain favorable combustion.

In the exemplary embodiment shown in FIG. 2, the air measuring member 4' is a baffle plate 35 whose shaft 36 is coupled to a sliding contact 37 of a potentiometer 38 supplied with constant DC potential. The potentiometer 38 has an exponentially increasing characteristic and hence delivers a control voltage which is at least approximately linear with respect to the air throughput and this control voltage is fed as a control parameter to an electronic control instrument 39. The electronic control instrument 39 controls four electromagnetically actuatable injection valves 40, of which each valve injects into one engine cylinder or one corresponding precombustion chamber associated with it. The magnetic valves 40 can be pump nozzles or they can also be high pressure injection valves. Control instrument 39, as is usual, contains a monostable multivibrator which is triggered by a signal source (not shown) coupled to the crankshaft of the engine and which determines the opening duration and, hence, the fuel quantity emerging from the injection valves. The adaption of the particular injection quantity is achieved by known means not shown. The injection valves 40 are supplied with fuel by a fuel pump 41 with the inlet pressure being controllable by a pressure control valve 42.

In the exemplary shown in FIG. 3, the signal derived from the air measuring member 4', which has the same configuration in this example as it did in the exemplary embodiment of FIG. 2, is electronically divided by a signal derived due to engine rpm in order to achieve a new signal measuring the quantity: air throughout/-working cycle. The fuel injection mechanism, in this case, includes a serial injection pump whose shaft rotates with engine rpm and is equipped with a signal generator 45, by means of which the rpm information is delivered to the control instrument 39. The actual value of the injection quantity is indicated by a potentiometer 46 whose slide contact 48 is coupled with a control rod 47. The potentiometer 46 has a linear characteristic so that the voltage delivered to the control instrument 39 is a linear function of the injected fuel quantity provided that the path of the control rod 47 has a linear relationship to the metered fuel quantity. The shaft 49 of the throttle flap 5 is connected to an eccentric point 50 of an adjustment lever 51 of the control rod 47 so that a movement of the throttle flap 5 by the gas pedal 15 results in a displacement of the control rod 47. This coarse adjustment of the injection quantity, corresponding to the actual value, is corrected by a magnetic servomotor 52 toward the nominal set value as determined by the electronic control instrument 39 from the electronically derived air throughput/working cycle quotient and from the position of the control rod 47 wherein these two values agree.

For this purpose it is possible, for example, to use a bridge circuit with comparison resistors within the electronic control instrument and the magnetic servo-motor 52 being placed in a diagonal branch of the bridge. The safety and maximum rpm shut-off regulation occurs, in this injection pump as well as in the others, as usual, by means of a centrifugal force governor 53.

Figure 4:
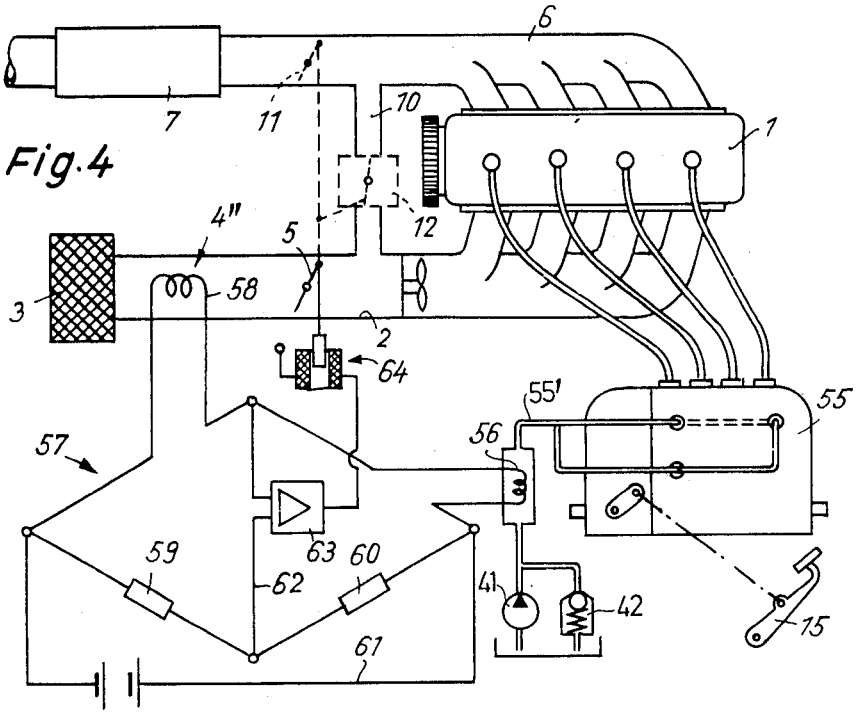
FIG. 4 is a schematic illustration of another embodiment of a fuel injection system for an internal combustion engine according to the present invention, wherein exhaust gas recycling is utilized and including details of still another embodiment of the assembled elements which control the quantity of the recycled exhaust gas. The assembled elements in this embodiment including an electrical bridge circuit.
Figure 5:
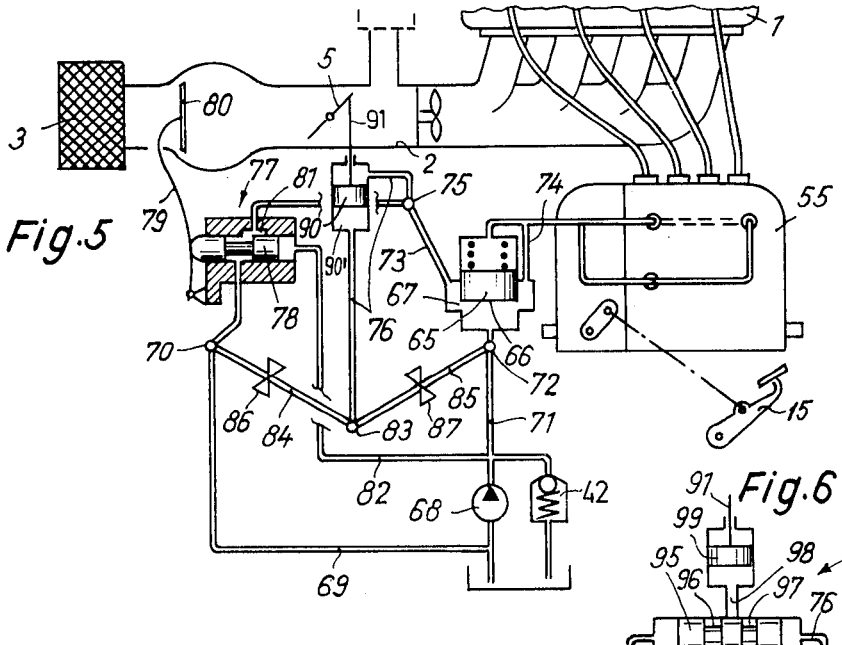
FIG. 5 is a schematic illustration of still another embodiment of a fuel injection system for an internal combustion engine according to the present invention, wherein exhaust gas recycling it utilized with the exhaust gas line not shown and including details of yet another embodiment of the assembled elements which control the quantity of the recycled exhaust gas. The assembled elements in this embodiment include a hydraulic bridge circuit.
Figure 6:
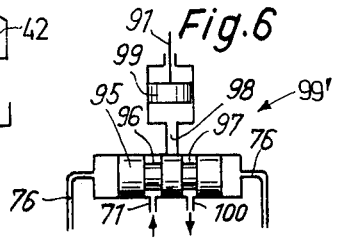
FIG. 6 is a detailed view of an alternate servomotor which could be utilized in a system such as that shown in FIG. 5.

In the two further exemplary embodiments shown in FIGS. 4, 5 and 6, the control parameter for the regulator is the injected fuel quantity. As is usual in diesel-type internal combustion engines, the gas pedal 15 of the vehicle determines the fuel injection quantity supplied by the injection pump 55. Customarily, the injection pump 55 operates with the hydraulic or mechanical regulator in which the injected quantity is regulated depending either on rpm or load. The injection pump 55 is usually driven directly by the engine at a speed corresponding to engine rpm. Thus, an installation of this type can be adpated to any existing diesel fuel injection system with the only requirement being that an exhaust gas recycle line 10, as well as means for controlling the pressures in the suction and exhaust systems of the internal combustion engine such as, for example, the throttle flap 5, be provided. In addition, an air measuring device 4'' is needed. Because it is intended that the injected fuel quantity be the control parameter, and because the quantity aspirated by the fuel injection pump 55 corresponds to the injected fuel quantity, it is sufficient to measure the quantity aspirated by the fuel injection pump 55 for measuring the actual value of the injection quantity.

In the exemplary embodiment shown in FIG. 4, this fuel quantity is measured by a heated wire 56, disposed in the pressure line 55' of the pump 55, and acting as a variable resistance in an electrical bridge circuit 57. Another heated wire 58 is disposed in a further branch of the bridge 57 and acts as a variable resistance measuring the air quantity in the suction tube 2. The remaining two branches of the bridge 57 contain fixed resistance 59 and 60. System line voltage is connected across one diagonal branch 61 of the bridge 57 whereas the second diagonal branch 62 of the bridge 57 carries the differential voltage which is amplified by an operational amplifier 63 and delivered to a magnetic setting mechanism 64 which sets the throttle flap 5 until the controlled fresh-air quantity passing the heated wire 58 causes a change of resistance whose consequence is that the voltage occurring across the diagonal branch 62 becomes zero.

In the exemplary embodiment shown in FIG. 5, use is made of a hydraulic circuit. In this case, the fuel quantity flowing to the fuel injection pump 55 is measured by a setting piston 65 which includes a control edge 66 which in turn controls a throttle slit 67 so that the path of the piston 65 is a linear function of the cross section of the throttle 67. One diagonal branch of this hydraulic bridge is formed by a fuel supply system with a supply pump 68. The suction side of the pump 68 is connected through a line 69 to a connecting point 70 of this diagonal branch and the pressure side of the pump 68 is connected through a line 71 with the other connecting point 72 of this diagonal branch. On the one hand, fuel flows from the connecting point 72 through the throttle slit 67 and a line 74 to the injection pump 55; while on the other hand it flows from the connecting point 72 through the throttle slit 67 and a branch 73 in which is disposed the fuel measuring mechanism including the piston 65, and further to a connecting point 75 of the bridge to which is also connected the second diagonal branch 76. Disposed within the branch lying between the connecting points 70 and 75 is a throttle valve 77. The throttle valve 77 has a throttle slide 78 which is actuated by a lever 79 having a free end lying within a suction tube to which a plate 80 is fastened to lie transverse to the stream direction, and this plate extends into a funnel portion of the suction tube 2, just as in the first exemplary embodiment. To this free end a plate 80 is attached in such a way that the path of the plate 80 corresponds to the air quantity flowing through the suction tube 2. The slide 78 controls a slit 81 in such a way that the path of the slide 78 corresponds to the open cross section of the valve 77. The resetting force for the slide 78 is obtained from pressure fluid which is supplied by the pump 68 through a channel 82 to the rear side of the slide 78. Lines 84 and 85, which respectively contain fixed throttles 86 and 87, are provided between the connecting points 70 and 72 and a fourth connecting point 83, to which the diagonal branch 76 is also connected. As soon as a differential pressure occurs between the connecting points 75 and 83 of the diagonal branch 76 (of the bridge as such), a piston 90 belonging to a hydraulic servo-motor 90' is displaced and this piston is connected with the throttle flap 5 by link means 91. Corresponding to a particular suction quantity of the injection pump 55 the piston 90, an hence the throttle flap 5, are displaced until such time as the aspirated fresh-air quantity corresponds to a nominal set value and this occurs when no pressure difference is any longer present between the connecting points 75 and 83 of the hydraulic bridge circuit.

The hydraulic servo-motor 99' shown in FIG. 6 contains a control slide 95, whose two setting surfaces respectively experience the pressures prevailing at the connecting points 75 and 83. The control slide 95 has annular grooves 96 and 97 controlling a bore 98 leading to the servo-motor 99' which, in turn, is connected by link means 91 with the throttle flap 5. The annular groove 96 communicates with the pressure line 71 of supply pump 68 and the annular groove 97 communicates with a pressure-relieved line 100.

Figure 7:
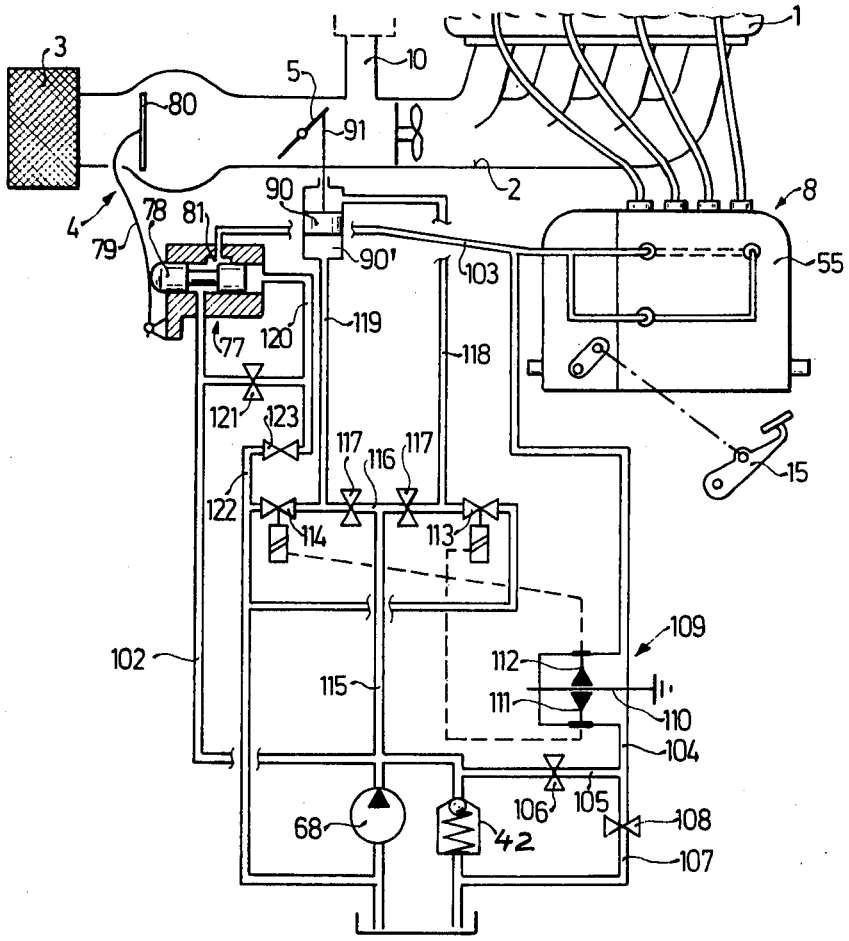
FIGS. 7, 8 and 9 are schematic illustrations of further embodiments of the assembled elements which control the quantity of the recycled exhaust gas.
Figure 8:
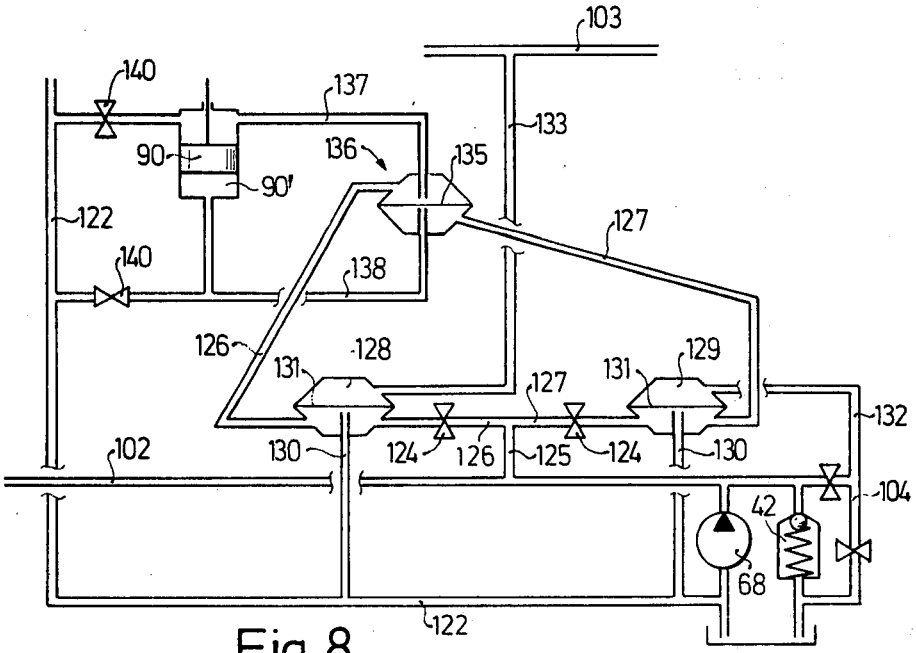
Figure 9:
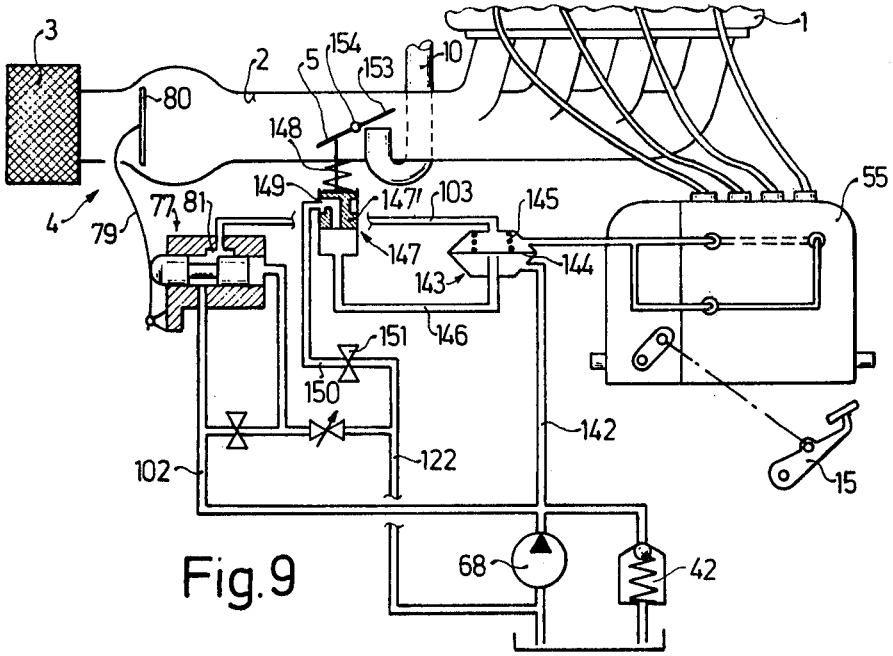

As was the case in the embodiment shown in FIGS. 4, 5, and 6, the control parameter for the regulator in the exemplary embodiment shown in FIGS. 7, 8 and 9, is the fuel injection quantity arbitrarily settable by the injection pump. As was the case in the exemplary embodiment of FIG. 5, the air measuring member 4 has the form of a lever 79 to whose free end is fastened a plate 80, transversely to the air stream direction. The member 4 actuates a throttle valve 77. The control valve slide 78 of the throttle valve 77 determines the opening of a control slit 81 so that the path of the slide 78 corresponds to the open cross section of the valve 77. Fuel under constant pressure is carried from the supply pump 68 through a line 102 to the throttle valve 77, and after flowing through the control slit 81, it is further carried through a line 103 to the injection pump 55. In a known manner, a well-defined pressure drop occurs in the control slit 81 corresponding to the amount of fuel flowing through the slit 81. This passing fuel quantity is determined by the driver operating the gas pedal 15, and hence determining the injection quantity of the pump 55. The pressure drop determined by the cross-sectional area of the control slit 81 is compared with the reference pressure in order to determine whether the nominal set value of the fresh-air quantity corresponds to the injected fuel quantity. The reference pressure is created in a line 104 which is connected to a line 102 by a line 105. The line 105 carries throttle 106 for pressure decoupling. Branching off from the line 104 is a line 107 leading back to the reservoir and also containing a throttle 108 intended to preserve a desired pressure. Depending on the difference between the pressure in the line 103 and the line 104, the servo-motor, including the piston 90, in the embodiments of FIGS. 7 and 8 is actuated and sets the throttle flap 5 by means of the links 91 until the difference in the pressures in the lines 103 and 104 has reached a desired value. According to the embodiment of FIG. 7, this purpose is achieved by a differential pressure indicator 109 operating with a membrane 110 whose one side is actuated by the pressure in the line 103 and whose other side is actuated by the pressure in the line 104. On each side of the membrane 110, which is preferably metallic, are located electrodes 111 and 112 which, depending on the pressure difference, can make contact with the membrane. Only when the pressure is equal is there no contact between either electrode and the membrane; i.e., when the pressures are equal in lines 103 and 104, the air quantity does correspond to the injected fuel quantity. Electrodes 111 and 112 control magnetic valves 113 and 114 which in turn control the quantity of fuel flowing to the servo-motor 90' and hence also the control pressure in the servo-motor 90'. In this case, too, the control fluid is fuel admitted through a line 115 which divides into lines 116 and in each of which there is disposed a throttle 117. Branching off downstream of the throttles are lines 118 and 119 which lead to the servo-motor on either side of the setting piston 90. The valves 113 and 114 are disposed in the further extent of the line 116. Downstream of the valves 113 and 114, the line 116 is carried back to the fuel container. Thus, as soon as valve 113 or 114 opens, the corresponding branch of the line 116 is opened so that fuel from the servo-motor can flow out of the line 118 or the line 119 without pressure; or on the contrary, as soon as one of these valves is closed, a pressure may build up at the corresponding side of the servo-motor. The resetting force of the air measuring member 4 is generated by a pressure fluid acting on the front end of the throttle slide 78 and is provided from line 102 through a line 120. Disposed in this line 120 is a decoupling throttle 121 whose purpose is to achieve as constant a resetting pressure as possible which is also independent of the pressure fluctuations in the line 102 caused by the changing control slit 81. Branching off from the line 120 is a line 122, terminating into line 116 downstream of the magnetic valve 114. Disposed in the line 122 is variable throttle 123 which permits setting the reset force, i.e. the pressure in the lne 120.

The installations described in FIG. 7 functions as follows:

Beginning with a condition of equilibrium prevailing in the regulator, i.e. equal pressures in the lines 103 and 104, the application of an open throttle results in a larger fuel supply quantity from the injection pump 55 and the equilibrium is disturbed. Due to the effect of the suction of the injection pump, the pressure in the line 103 decreases and the pressure gradient in the control slit 81 is correspondingly increased. Due to the pressure decrease in the line 103, the membrane 110 is displaced toward the electrode 112 opening the normally closed valve 114. Opening of the valve 114 causes a pressure decrease in the line 119 and a corresponding downward displacement of the servo-motor causes the throttle flap 5 to open up the suction tube 2. The opening of the suction tube 2 causes an increase of the fresh-air flow passing the plate 80 as compared with the exhaust gas flow aspirated through the recycle line 10. Corresponding to this increase of the fresh-air flow, the slide 78 of the throttle valve 77 is displaced and the control slit 81 is further opened, which, in turn, results in an increase of pressure in the line 103. As soon as pressure equilibrium again prevails in the lines 103 and 104, the membrane 110 is released from the electrode 112 and assumes its central position. Consequently, the magnetic valve 114 closes and the servo-motor 90' remains in the corresponding control position. When the injection quantity is subsequently reduced again, the pressure in the line 103 rises, due to the corresponding additional supply of system pressure in the line 102, and the membrane 110 is displaced toward electrode 111. This, in turn, has the consequence that the magnetic valve 113 is opened and the servo-motor 90' again closes the throttle flap 5 further until a pressure equilibrium, corresponding to the injected fuel quantity, prevails in the lines 103 and 104.

In the exemplary embodiment shown in FIG. 8, purely hydraulic means are used instead of the electrical means of FIG. 7. Three equal pressure valves are used to displace the servo-motor 90' until the pressure in the lines 103 and 104 is the same. Otherwise this regulator functions in the same way as that in FIG. 7 and, for this reason, individual and equivalent means are not shown. Branching off from the line 102 is a line 125 which carries fuel under pressure to lines 126 and 127. Disposed within the lines 126 and 127 are throttles 124 which serve for a certain degree of decoupling from the system pressure in the line 102. Downstream of these throttles there are disposed in lines 126 and 127 equal pressure valves 128 and 129 through which and depending on the difference in the pressures in the lines 103 and 104, a portion of the fuel may flow to the lines 130 and from there into the return line 122 and ultimately into the fuel reservoir. For this purpose the valves 128 and 129 are equipped with a dividing membrane 131. One side of the membrane 131 in the valve 129 experiences the pressures in the line 104 which is transmitted through a line 132, whereas in the valve 128, one side of the membrane 131 experiences the pressure in the line 103 transmitted through a line 133. The other sides of the membranes 131 are actuated by the pressure prevailing downstream of the throttles 124 in the lines 126 and 127. Accordingly, when the pressure in the lines 132 and 133 increases, less fuel flows off through the lines 130 and vice versa. The pressure in the lines 126 and 127 is changed accordingly. This pressure, in turn, acts upon a membrane 135 of an analog control regulating valve 136. The membrane 135 controls the ends of two lines 137 and 138 which lead to eiher side of a setting piston 90 in the servo-motor 90' and then back to the return line 122. Downstream of the servo-motor 90', the lines 137 and 138 contain build-up throttles 140.

The principle of operation of this exemplary embodiment is exactly the same as that of FIG. 7. As soon as a pressure difference occurs between the lines 103 and 104, the pressure in the valves 128 and 129 above membrane 131 is correspondingly changed. This, in turn, results in a differential flow-off of fuel through the lines 130. The differential flow-off, in turn, results in a differential pressure-activation of the membrane 135 in the regulating valve 136 which causes it to be displaced either toward the line 137 or the line 138. Corresponding to the resulting greater throttling, this pressure difference is transmitted to the servo-motor 90' which results in the desired setting of the throttle flap 5.

In the exemplary embodiment shown in FIG. 9, the pressure of the supply pump 68 is transmitted through a line 142 directly to a differential pressure valve 143. This differential pressure valve 143 functions by means of a membrane 144 whose upper surface experiences pressure prevailing in the line 103 as well as the force of a spring 145 causing the differential pressure. The lower side of the membrane 144 controls the terminating aperture of a line 146 and experiences pump pressure admitted to it through the line 142. The line 146, in turn, leads to the servo motor 147 whose piston 147' is slidable against the force of a spring 148. Located in the piston 147' is a throttle channel 149 through which fuel can continuously flow into a return line 150 which contains a pressurizing throttle 151 for additional adjustment. Thus, as soon as the pressure in the line 103 decreased due to an increasing injection quantity, the membrane 144 is displaced upwardly against the force of the spring 145 and against the fluid pressure prevailing in the line 103 and thus opens the line 146 further. As a result, the piston 147' is displaced and opens the throttle flap 5 in the desired manner until, because of the enlargement of the throttle slit 81 in the line 103, the previous pressure prevails again.

In contrast to the other embodiments, the throttle flap 5 controls the terminating aperture of the exhaust gas recycle line 10. It should be noted, however, that this configuration of the recycle line 10 is possible in the other embodiments as well. For the purpose of controlling the terminating aperture of the recycle line 10, use is made of the section 153 of the throttle flap 5 which operates downsteam of the axis 154 in the suction tube 2. This disposition has the advantage that the unimpeded motion of the throttle flap 5 is not substantially deteriorated by contamination and dirt. The closure of the exhaust gas recycle line 10 during full load operation, i.e. with a fully opened throttle flap 5, can be of importance when the air quantity measuring member 4 operates with a relatively large pressure drop in the suction tube 2 or when high gauge pressure prevails in the exhaust system during full load operation so that exhaust gas could be unintentionally aspirated through the exhaust gas recycle line 10.

Regulating systems corresponding to FIGS. 1 and 9 can also be used in externally ignited engines (spark plug ignited) using fuel injection.

They can especially be used also in a directly injected stratified charge engine which requires intermittent, timed injection just as does a self-igniting internal combustion engine.

What is claimed is:

1. In a fuel injection system for an internal combustion engine, including a suction tube through which air for engine combustion is drawn, an exhaust gas line through which engine exhaust gas flows, an exhaust gas recycle line, a control mechanism including a throttle flap member mounted in any one of said suction tub, exhaust gas line and recycle line extending between and being connected to the suction tube and the exhaust line to thereby establish a flow path for a recycled portion of the exhaust gas flow through the exhaust gas line to the suction tube, with the connection of the recycle line to the suction tube being downstream of the location of the throttle flap member in the suction tube, and with the connection of the recycle line to the exhaust gas line being upstream of the location of the throttle flap member in the exhaust gas line, said throttle flap member controlling the pressure drop between the exhaust gas line and the suction tube for determining the flow rate of the recycled portion of the exhaust gas, fuel injection means, and regulating means for regulating the quantity of fuel injected by the fuel injection means, said regulating means including an air measuring member mounted within the suction tube and comparison means connected to the air measuring member and the fuel injection means, with the position of said throttle flap member in its respective tube or line defining a control parameter which is detected by the air measuring member and transmitted to the comparison means for adjusting the quantity of fuel injected by the fuel injection means.

2. The fuel injection system as defined in claim 1, wherein said, throttle flap member is mounted within said suction tube.

3. The fuel injection system as defined in claim 1, wherein said throttle flap member is mounted within said exhaust gas line.

4. The fuel injection system as defined in claim 1, wherein said throttle flap member is mounted within said exhaust gas recycle line.

5. The fuel injection system as defined in claim 1, wherein said throttle flap member is mounted in said suction tube and in said exhaust gas line.

6. The fuel injection system as defined in claim 1, further including a gas pump, and wherein said gas pump is disposed in said suction tube beyond the termination of said exhaust gas recycle line.

7. The fuel injection system as defined in claim 1, further including a cooler, and wherein said cooler is disposed in said suction tube beyond the termination of said exhaust gas recycle line.

8. The fuel injection system as defined in claim 1, wherein said system further includes an operator-controlled gas pedal and means connecting said pedal to said throttle flap member which is arbitrarily settable by said gas pedal, and wherein said air measuring member measures the fresh air flow in said suction tube and produces an output parameter which serves as a control parameter for the regulating process effected by said regulating means.

9. The fuel injection system as defined in claim 8, wherein said fuel injection means comprises a suction throttle injection pump, and wherein said comparison means includes a fuel metering valve which is controlled by the control parameter produced by said air measuring member.

10. The fuel injection system as defined in claim 9, wherein said comparison means further includes a differential pressure equalizing valve having a control member mounted therein, wherein said air measuring member includes a lever pivotably mounted at one end to said fuel metering valve and having a disc mounted to its other end, said disc being located within said suction tube transversely to the direction of air flow, wherein said fuel metering valve includes a metering piston which is actuated by said lever in proportion to the air quantity flowing through said suction tube, with said metering portion defining a suction throttle, and said differential pressure equalizing valve including means connecting it to said fuel metering valve such that one side of said control member is exposed to the pressure existing on one side of said suction throttle and the other side of said control member is exposed to the pressure existing on the other side of said suction throttle.

11. The fuel injection system as defined in claim 9, wherein said comparison means further includes an rpm-dependent member connected to said injection pump, and wherein the maximum rpm regulation of said injection pump is carried out by said rpm-dependent member.

12. The fuel injection system as defined in claim 11, wherein said rpm-dependent member comprises a centrifugal force governor.

13. The fuel injection system as defined in claim 9, wherein said comparison means further includes a suction line connected between said fuel metering valve and said injection pump and a container defining a fuel storage volume serving to adapt the intermittent suction strokes of said injection pump to the continuous metering of said fuel metering valve.

14. The fuel injection system as defined in claim 8, wherein said comparison means includes an electronic control device which receives electrical signals characteristic of the fresh-air flow and the engine rpm and electronically divides the fresh-air flow signal in accordance with time and engine rpm to produce an output signal characteristic of air-throughput per working cycle, which output signal serves as the reference parameter for the injection process.

15. The fuel injection system as defined in claim 14, wherein said air measuring member comprises a baffle plate and an electrical position indicator connected to said baffle plate, and wherein said air measuring member delivers an electric output signal to said electronic control device characteristic of the quantity of the fresh-air flow.

16. The fuel injection system as defined in claim 14, wherein said air measuring member comprises a temperaturedependent resistance element, and wherein said air measuring member delivers an electric output signal to said electronic control device characteristic of the quantity of the fresh-air flow.

17. The fuel injection system as defined in claim 14, wherein said fuel injection means further includes a fuel injection apparatus comprising a plurality of magnetic valves whose opening duration and timing correspond to the reference parameter of the injection process.

18. The fuel injection system as defined in claim 14, wherein said fuel injection means further includes a fuel injection apparatus comprising an injection pump having a supply quantity setting member coupled to said throttle flap member and wherein the setting of said setting member is adjusted to the reference parameter of the injection process.

19. The fuel injection system as defined in claim 18, wherein said comparison means includes a bridge circuit, and wherein said setting member is displaced by means of said bridge circuit until its position corresponds to the reference parameter of the injection process.

20. The fuel injection system as defined in claim 18, wherein said comparison means further includes an electric rpm meter, wherein the injection pump comprises a serial pump, and wherein said setting member comprises a control rod and a potentiometer with the position of said control rod being determined by means of said potentiometer which generates a signal characteristic of said position and delivers it to said electronic control device, said electronic control device also receiving a signal from said electric rpm meter characteristic of the rpm of the injection pump shaft.

21. The fuel injection system as defined in claim 20, wherein said comparisom means further includes lever means connected to said control rod, a magnetic servomotor and a centrifugal governor means, wherein a course adjustment of the fuel injection quantity occurs by changing the pivotal point of said lever means, wherein a fine adjustment occurs by means of said magnetic servo-magnet which is actuated by said electronic control device and wherein a safety shut-off is provided by said centrifugal governor means.

22. In a fuel injection system for an internal combustion engine, including a suction tube through which air for engine combustion is drawn, an exhaust gas line through which engine exhaust gas flows, an exhaust gas recycle line, a control mechanism including a throttle flap member mounted in any one of said suction tube, exhaust gas line and recycle line, with the recycle line extending between and being connected to the suction tube and the exhaust gas line to thereby establish a flow path for a recycled portion of the exhaust gas flow through the exhaust gas line into the suction tube, with the connection of the recycle line to the suction tube being downstream of the location of the throttle flap member in the suction tube, and with the connection of the recycle line to the exhaust gas line being upstream of the location of the throttle flap member in the exhaust gas line, said throttle flap member controlling the pressure drop between the exhaust gas line and the suction tube for determining the flow rate of the recycled portion of the exhaust gas, fuel injection means, and regulating means for regulating the quantity of fuel injected by the fuel injection means, said regulating means including an air measuring member mounted within the suction tube and comparison means connected to the air measuring member, the throttle flap member and the fuel injection means, wherein the fuel quantity delivered by said fuel injection means is arbitrarily variable, with said injection quantity serving as a control parameter which is detected by said comparison means and transmitted to the throttle flap for adjusting the quantity of air and recycled portion of the exhaust gas drawn into the engine.

23. The fuel injection system as defined in claim 22, wherein said comparison means further includes a bridge circuit including means for detecting a parameter characteristic of the fuel injection quantity and a parameter characteristic of the fresh-air quantity and means for comparing said parameters, and wherein the bridge circuit changes the setting of said throttle flap member and correspondingly the fresh-air flow and the flow of recycled exhaust gas whenever a deviation from a nominal set value occurs, said setting change continuing until the nominal set value is reached.

24. The fuel injection system as defined in claim 23, wherein said air measuring member comprises a baffle plate and a potentiometer having an electrical position indicator, said air measuring member delivering an electrical output signal which corresponds to the fresh-air quantity, and wherein said comparison means also includes means for providing an electrical output signal which corresponds to the fuel quantity.

25. The fuel injection system as defined in claim 23, wherein said air measuring member comprises a temperature-dependent resistance element disposed within the air stream and wherein said comparison means further includes a temperature-dependent resistance element disposed within the fuel stream, said temperature-dependent resistance elements providing an electrical output signal corresponding to the air quantity and fuel quantity, respectively.

26. In a fuel injection system for an internal combustion engine, including a suction tube through which air for engine combustion is drawn, an exhaust gas line through which engine exhaust gas flows, an exhaust gas recycle line, a control mechanism including a throttle flap member mounted in any one of said suction tube, exhaust gas line and recycle line, with the recycle line extending between and being connected to the suction tube and the exhaust gas line to thereby establish a flow path for a recycled portion of the exhaust gas flow through the exhaust gas line into the suction tube, with the connection of the recycle line to the suction tube being downstream of the location of the throttle flap member in the suction tube, and with the connection of the recycle line to the exhaust gas line being upstream of the location of the throttle flap member in the exhaust gas line, said throttle flap member controlling the pressure in its respective tube or line for determining the flow rate of the recycled portion of the exhaust gas, and regulating means including an air measuring member mounted within the suction tube and a fuel injection apparatus for regulating the quantity of fuel injected by the system, wherein the fuel quantity delivered by said fuel injection apparatus is arbitrarily variable, with said injection quantity serving as a control parameter for said regulating means, said fuel injection apparatus including:

a. an injection pump;
b. a fuel measuring member for said injection pump;
c. a servo-motor; d. two fixed opening throttle members; e. means defining a first variable throttle slit;
f. means defining a second variable throttle slit; and
g. a hydraulic bridge circuit with means for detecting a parameter characteristic of the fuel injection quantity and a parameter characteristic of the fresh-air quantity, and with means for comparing said parameters, wherein:
   i. one diagonal branch of said bridge circuit serves as a fuel delivery and drainage line and the other diagonal branch is connected with said servomotor and said throttle flap member;
   ii. said throttle members are disposed in different ones of said bridge arms so that they can be in hydraulic communication with said first and second throttle slits;
   iii. said first throttle slit is variably set by said furl measuring member and said second throttle slit is variably set by said air measuring member; and
   iv. the bridge circuit changes the setting of the throttle flap member and correspondingly the fresh-air flow and the flow of recycled exhaust gas whenever a deviation from a nominal set value occurs, said setting change continuing until the nominal set value is reached.

27. The fuel injection system as defined in claim 24, wherein said fuel measuring member comprises a piston, a cylinder within which said piston is displaceable, and means connecting said piston to said injection pump, said cylinder comprising said means defining said first throttle slit, wherein said piston is displaced in correspondence with the quantity of fuel flowing to said injection pump, and wherein said piston controls the cross section of an aperture in said cylinder serving as said first throttle slit.

28. The fuel injection system as defined in claim 26, wherein the servo-motor comprises a slide member actuated on both ends thereof and being disposed in one branch of said bridge circuit.

29. The fuel injection system as defined in claim 28 wherein said servo-motor further comprises a piston, and wherein said slide member comprises a control slide which controls the fuel flow to said piston.

30. The fuel injection system as defined in claim 22, wherein said comparison means further includes means connecting said throttle flap member to said comparison means, means defining a reference pressure for said comparison means, a throttle valve, said air measuring member being connected to said throttle valve and a suction line connected to said throttle valve and said injection pump means, said throttle valve defining a throttle slit and having means engaging said air measuring member for adjusting the extent of said slit, and wherein said throttle valve is displaceable in dependence on the quantity of fuel flowing and the quantity of fresh-air aspirated thereby developing a pressure drop in said suction line with respect to said reference pressure, and as a result said regulating means changes through said connecting means the setting of said control mechanism and thereby the fresh-air flow and the recycle gas flow.

31. The fuel injection system as defined in claim 30, wherein said means defining a reference pressure for said comparison means includes a fuel pump, a pressure line connected to said fuel pump and to said throttle valve, a pair of return lines branching off from said pressure line, and adjustable throttle means in each of said return lines, wherein said reference pressure being determined by the fuel flow in said pressure line, and wherein said reference pressure is varied by adjustment of said adjustable throttle means.

32. The fuel injection system as defined in claim 31, wherein said throttle valve means engaging said air measuring member comprises a slide valve member, wherein said air measuring member includes a lever pivotably mounted to said throttle valve for nearly friction-free pivoting and a plate mounted to the free end of said lever, said plate being mounted in said suction tube transverse to the fresh-air stream, said lever engages one side of said slide valve member while the other side thereof is exposed to a fluid which exerts a variable pressure against said other side, and wherein said plate is displaced in proportion to the flow of fresh air through said suction tube and communicates this displacement through said lever to said one side of said slide valve member, with the pressure exerted by the fluid against the other side of said slide valve serving as a resetting force for said slide valve.

33. The fuel injection system as defined in claim 30 wherein said comparison means further includes hydraulically actuated differential pressure switch means connected to said suction line and to said means defining a reference pressure for comparing the pressure in said suction line and the reference pressure, a hydraulic servo-motor including said means connecting said control mechanism to said comparison means, and magnetic valve means which control the fluid flow to said servo-motor.

34. The fuel injection system as defined in claim 30, wherein said comparison means further includes an analog control valve and a pair of equalizing valves connected thereto, wherein said means connecting said throttle flap member to said comparison means includes a servo-motor, and wherein said equalizing valves regulate the fluid pressure in said analog control valve to be equal to suction line pressure, said analog control valve thereby controlling said servo-motor.

35. The fuel injection system as defined in claim 34, wherein said comparison means further includes a relief line, said equalizing valves each having membrane member mounted therein, wherein said membrane members control said relief line for the purpose of obtaining equalized pressures, and wherein one side of said membranes is exposed to suction line pressure while the other side thereof is actuated by fluid delivered to said analog control valve.

36. The fuel injection system as defined in claim 34, wherein said comparison means further includes a relief line, said equalizing valves each having a membrane member mounted therein, wherein said membrane members control said relief line for the purpose of obtaining equalized pressures, and wherein one side of said membranes is exposed to the reference pressure while the other side thereof is actuated by fluid delivered to said analog control valve.

37. The fuel injection system as defined in claim 30, wherein said comparison means further includes an analog control valve and a pair of equalizing valves connected thereto, wherein said means connecting said throttle flap member to said comparison means includes a servo-motor, and wherein said equalizing valves regulate the fluid pressure in said analog control valve to be equal to the reference pressure, said analog control valve thereby controlling said servo-motor.

38. The fuel injection system as defined in claim 37, wherein said comparison means further includes a relief line, said equalizing valves each having a membrane member mounted therein, wherein said membrane members control said relief line for the purpose of obtaining equalized pressures, and wherein one side of said membranes is exposed to suction line pressure while the other side thereof is actuated by fluid delivered to said analog control valve.

39. The fuel injection system as defined in claim 37, wherein said comparison means further includes a relief line, said equalizing valves each having a membrane member mounted therein, wherein said membrane members control said relief line for the purpose of obtaining equalized pressures, and wherein one side of said membranes is exposed to the reference pressure while the other side thereof is actuated by fluid delivered to said analog control valve.

40. The fuel injection system as defined in claim 30, wherein said comparison means further includes a differential pressure valve and a setting motor, wherein said means defining a reference pressure for said comparison means includes a fuel pump whose system pressure equals the reference pressure, wherein the suction line pressure and the reference pressure are compared by said differential pressure valve, and wherein the fuel quantity flowing off because of a deviation from a nominal differential pressure is carried to said servo-motor.

41. The fuel injection system as defined in claim 1, wherein said exhaust gas recycle line defines an open end at its termination in said suction tube, and wherein said throttle flap controls the opening of said open eng.

42. The fuel injection system as defined in claim 41, wherein said throttle flap is mounted in said suction tube and includes a downstream section which effects control of said open end.

43. The fuel injection system as defined in claim 22, wherein said exhaust gas recycle line defines an open end at its termination in said suction tube, and wherein said throttle flap controls the opening of said open end.

44. The fuel injection system as defined in claim 43, wherein said throttle flap is mounted in said suction tube and includes a downstream section which effects control of said open end.

45. The fuel injection system as defined in claim 1, wherein said throttle flap member is mounted within said suction tube which generates a control parameter for a stratified injection distribution of a stratified charged engine.

* * * * *